US007478868B2

(12) United States Patent
Figueras Mitjans

(10) Patent No.: US 7,478,868 B2
(45) Date of Patent: Jan. 20, 2009

(54) ARMCHAIR TABLET HINGE SYSTEM

(75) Inventor: Jose Figueras Mitjans, Barcelona (ES)

(73) Assignee: Figureas International Seating, S.A., Llica d'Amunt, Barcelona (ES)

( * ) Notice: Subject to any disclaimer, the term of this patent is extended or adjusted under 35 U.S.C. 154(b) by 236 days.

(21) Appl. No.: 10/595,685

(22) PCT Filed: Nov. 4, 2004

(86) PCT No.: PCT/ES2004/000488

§ 371 (c)(1),
(2), (4) Date: Jun. 29, 2006

(87) PCT Pub. No.: WO2005/044052

PCT Pub. Date: May 19, 2005

(65) Prior Publication Data

US 2007/0132283 A1 Jun. 14, 2007

(51) Int. Cl.
*A47B 39/00* (2006.01)

(52) U.S. Cl. ..... 297/162; 297/145; 297/160; 297/161

(58) Field of Classification Search ..... 297/145, 297/160, 161, 162
See application file for complete search history.

(56) References Cited

U.S. PATENT DOCUMENTS 3,351,377 A * 11/1967 Anderson ..... 297/162
3,547,488 A * 12/1970 Barnes ..... 297/162
3,556,588 A * 1/1971 Monyer et al. ..... 297/162
3,598,442 A * 8/1971 Miller ..... 297/22
5,683,136 A * 11/1997 Baumann et al. ..... 297/162
6,073,997 A * 6/2000 Koh ..... 297/173
6,220,658 B1 4/2001 Lukawski et al.
6,427,957 B1 * 8/2002 Finneman et al. ..... 248/185.1
6,837,539 B1 * 1/2005 Casey ..... 297/162
7,143,701 B2 * 12/2006 Lindstrom et al. ..... 108/44

FOREIGN PATENT DOCUMENTS

DE 2826389 Y 12/1979
ES 282121 A 5/1985
ES 1033482 A 9/1996
JP 02291809 A * 12/1990
JP 9206170 Y 8/1997

* cited by examiner

*Primary Examiner*—Laurie K Cranmer
(74) *Attorney, Agent, or Firm*—Lucas & Mercanti, LLP

(57) ABSTRACT

The invention relates to an armchair tablet hinge system. According to the invention, the tablet (1) is mounted to an armrest of the armchair by means of a support (4), said support containing a hollow shaft (5). The end of the hollow shaft is provided with a head (6) to which the tablet (1) is articulated by means of a cam-shaped element (7). In addition, rod (10) is housed in the aforementioned shaft (5) and is pushed against the cam-shaped element (7) by means of a spring (11). Moreover, the end of the rod (10) can be inserted into a notch (13) in the cam (7) in order provisionally to block the rotation of the tablet (1).

3 Claims, 5 Drawing Sheets

ARMCHAIR TABLET HINGE SYSTEM

FIELD OF THE INVENTION

The present invention relates to arranging a foldable tablet in armchairs or chairs the use of which requires a support means for facilitating writing, note taking, document or book handling etc. by the user, proposing for that purpose an articulating assembly allowing the incorporation of a tablet in refolding conditions with antipanic quality.

STATE OF THE ART

In the armchairs of conference halls or the like, wherein the use requires or can require a support for writing or handling documents, the arrangement of a tablet is known, the incorporation of which is generally carried out on the armrest of the suitable hand in the corresponding armchair.

According to a known embodiment, the mentioned tablet of the armchairs is arranged in a articulated assembly that allows placing the tablet in a horizontal position in front of the position of the seat for use, as well as refolding it to a furled position to free the access to the position of the seat and the walking without obstacles to said seat.

When the armchairs correspond to installations of armchair assemblies in rows, the folding of tablets is determined by the folding and housing of the same under the armrest itself in which they are mounted.

In the known embodiments, the articulated assembly of the mentioned tablets determines a rotation between the horizontal position for use and a vertical perpendicular position, complemented with another rotation between a raised position and a downwards folded position; such that to place the tablet in the position for use and to refold it to the furled position, two indicated movements must be carried out consecutively, in one direction or the other respectively depending on the change of position which is intended.

This means that when a user is seated in an armchair with the corresponding tablet in the position for use, he must carry out the two folding movements of the tablet to clear the armchair, that is, first he has to rotate it to the vertical position and then fold it downwards, which restricts the freedom of clearing the armchair quickly, which can be conditioning in emergencies, as well as being a nuisance in normal circumstances.

On the other hand, folding the tablet to the lower position usually causes a rebound making the tablet return to the intermediate folding position, in which it projects towards the front of the armchair in application.

OBJECT OF THE INVENTION

According to the invention, an armchair tablet hinge system is proposed, with which more advantageous functional features are obtained than with conventional systems, efficiently solving the drawbacks of the latter with respect to the folding of the tablet in the furled position.

The hinge system object of the invention is established by means of a support fixed to the armrest of the armchair in application, through which support a hollow shaft is provided having a limiting stop for the rotation between two angular positions, while in its end, said shaft has a head with respect to which the tablet is articulated by means of a rotatory cam, a feeler being included axially inside the hollow shaft which establishes a provisional rotatory retention with the cam of the tablet in the folded position of the latter.

The limiting stop of the rotation of the hollow shaft is determined by a perpendicular bolt incorporated on said shaft and an angular notch defined on the assembly support, with respect to which the perpendicular bolt of the shaft acts.

The locking follower on the cam of the tablet consists of a rod included axially in the hollow shaft and which is pushed by a spring to project through the head of the shaft, said rod incorporating a roller at its end which rests on the periphery of the cam of the tablet, being capable of being inserted into a notch defined in an area of said periphery of the cam of the tablet.

Thus a hinge system for the assembly of the tablet is obtained, according to a very simple embodiment, with which the movement of the tablet from the furled position to the position for use is similar to that of conventional assemblies, but the folding from the position for use to the furled position is achieved by simply pushing the tablet forwards, because by taking this outwards, in a certain position it rotates by itself to the vertical position and falls to the folded position.

With this, a very quick action is achieved for folding the tablet with only one pushing movement by the user, such that in an emergency, clearing the exit from the armchair does not oppress the user, providing therefore an antipanic quality. An aid for rotating the tablet to the falling position is further established by means of a torsion spring, making the folding action even more efficient and quick.

When the tablet falls to the folded position, the locking follower provides a retention preventing the rebound, which prevents the tablet from being projected in a blocking position towards the front of the armchair in application.

Due to all this, the proposed system clearly results in very advantageous features, such that its implementation becomes feasible and with a preferred character with respect to conventional folding assemblies of armchair tablets.

DETAILED DESCRIPTION OF THE INVENTION

Figure 1:
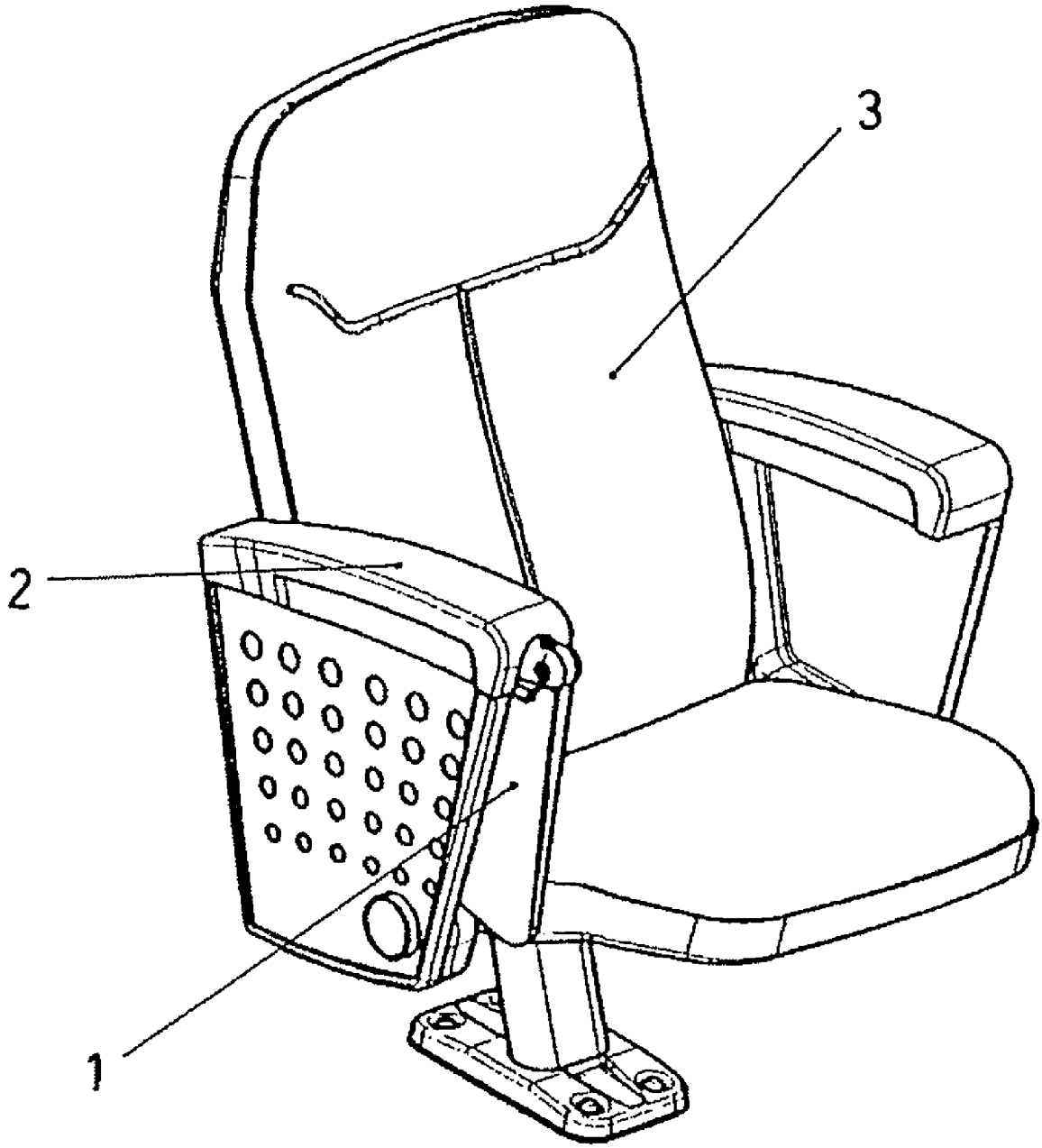
FIG. 1 shows a perspective view of an armchair provided with a tablet according to the proposed system.
Figure 2:
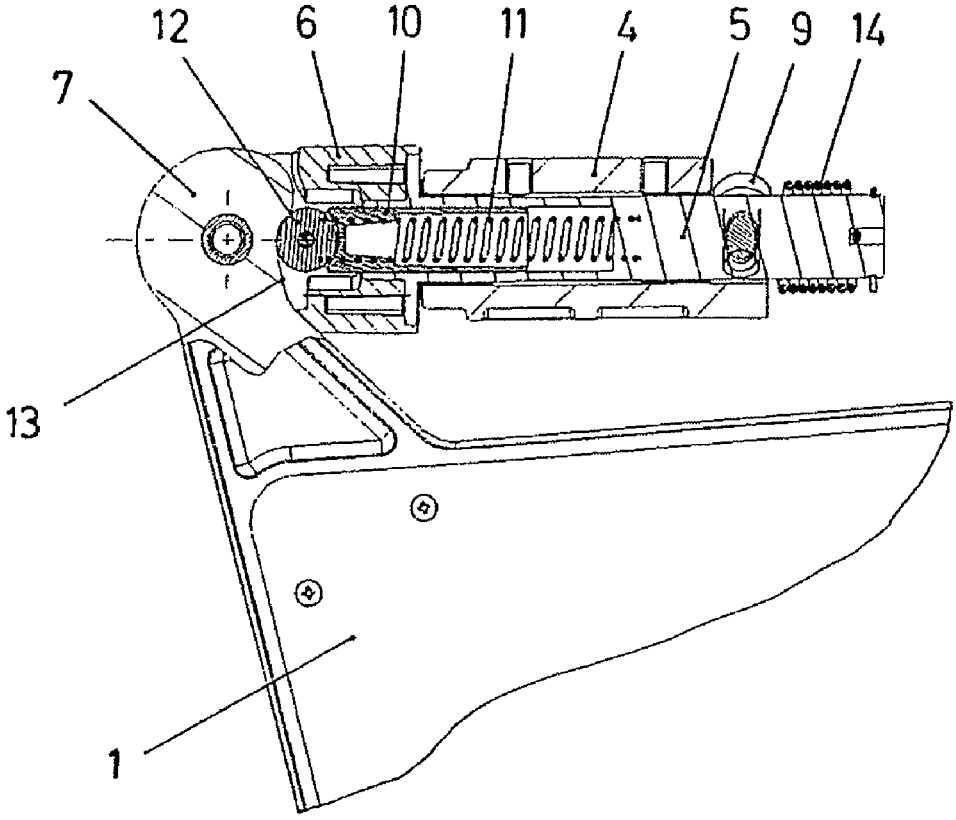
FIG. 2 is a sectional view of the articulating mechanism of the tablet according to said system of the invention.
Figure 3:
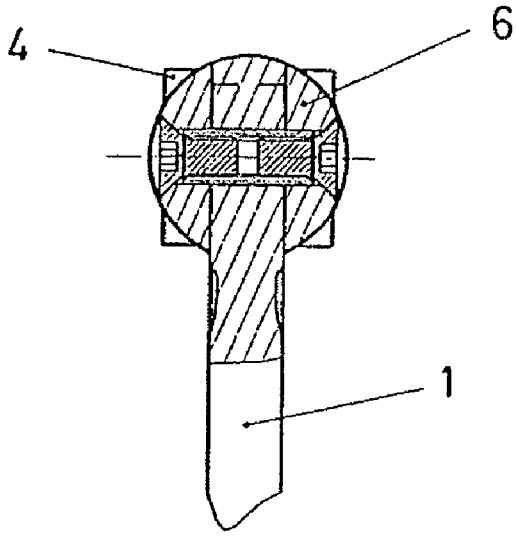
FIG. 3 is a cross-sectional detail of the rotating tablet assembly.
Figure 4:
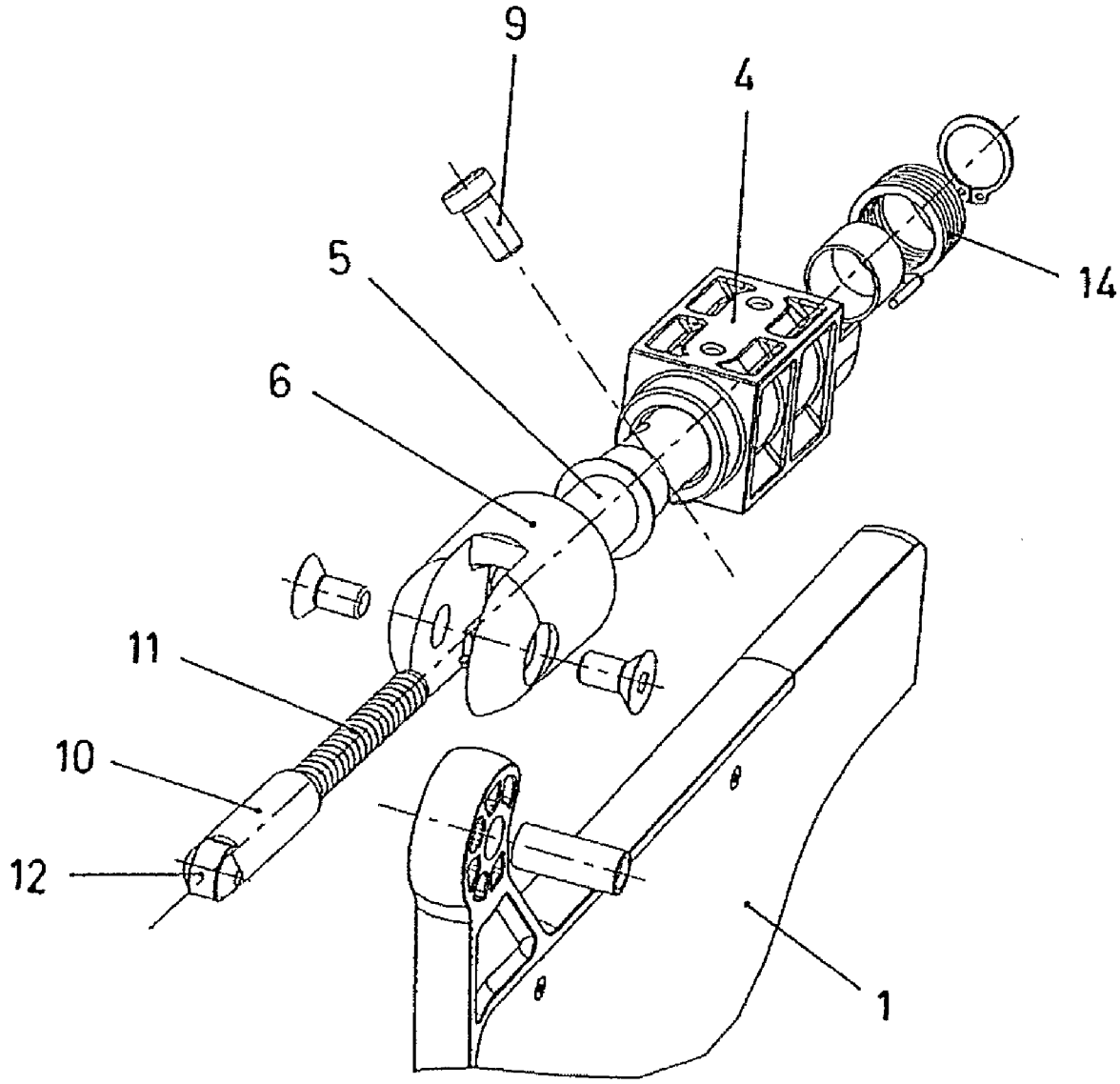
FIG. 4 is an exploded view of the mechanism of FIG. 2.
Figure 5:
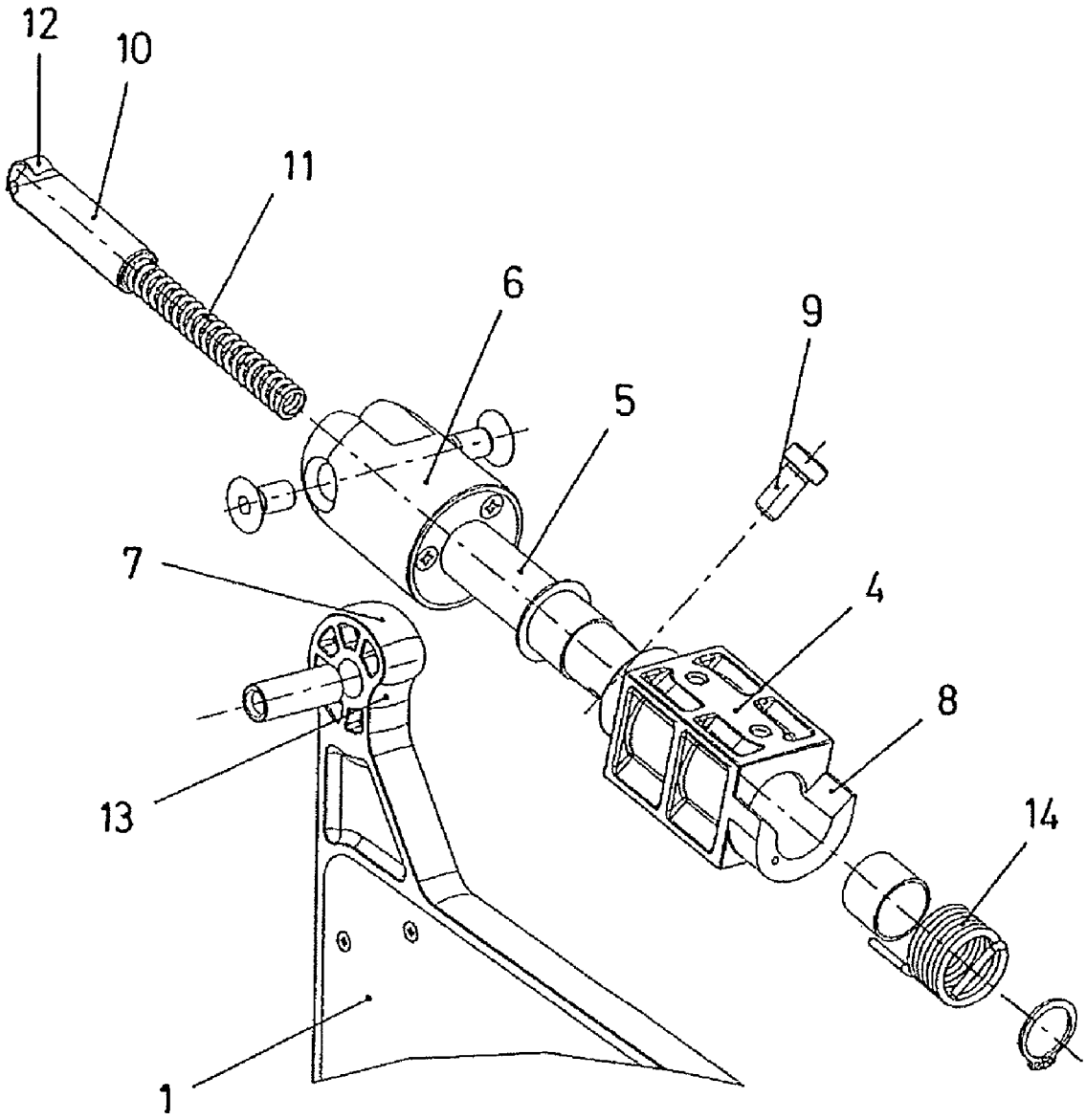
FIG. 5 is an exploded view of said mechanism of the previous figure, observed from the other side.

The object of the invention relates to an arrangement of a tablet hinge system incorporated in armchairs, establishing an assembly which allows folding tablet (1), corresponding to the furled position under the armrest (2) of the assembly of the armchair (3) in application, by simply pushing the tablet (1) forwards, from the position for use, to be perfectly gathered in the furled position.

According to the invention, the arrangement of tablet (1) in the armrest (2) of the armchair (3) in application is established by means of an assembly support (4), which is included fixed with respect to the armrest (2) a rotating hollow shaft (5) being incorporated axially with respect to said support (4).

The shaft (5) has in its front end a head (6), with respect to which the tablet (1) is articulated by means of a cam-shaped element (7) projecting in an area of a corner of the same.

The support (4) has in its rear part an angular notch (8), while the shaft (5) incorporates in its rear end a perpendicular bolt (9) acting with respect to the mentioned notch (8) of the support (4), determining two stop positions limiting the rotation of the shaft (5) between two defined angular positions.

Inside shaft (5), there is a rod (10) included with axial freedom which is pushed by a spring (11) to project through the head (6), so that in the assembly arrangement said rod (10) rests with pressure on the periphery of the cam (7) of the tablet (1).

A roller (12) is incorporated in the end of the rod (10) by means of which said rod (10) provides a rotation support on the periphery of the cam (7).

In an end area of its contour, the cam (7) defines a notch (13) in which it is capable to fit the end of the rod (10) provided with the roller (12), such that when said fitting is established, a provisional blocking of the rotation of the tablet (1) is determined between the cam (7) and the shaft (5) with respect to the shaft (5).

Figure 7:
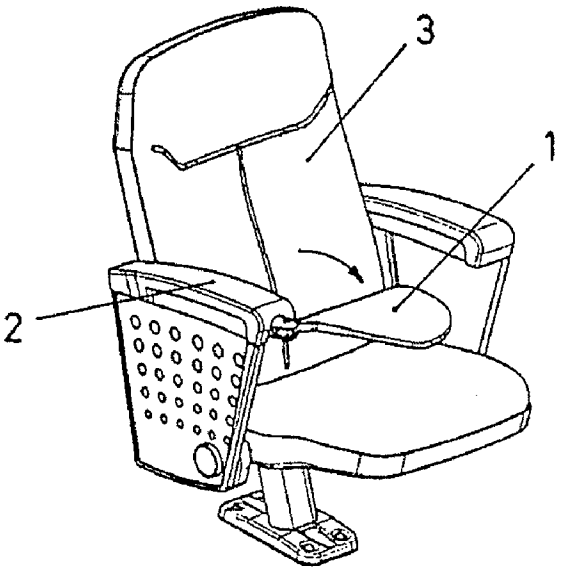
FIGS. 6 and 7, show two positions in the tablet unfolding sequence, from the furled position to the position for use.
Figure 6:
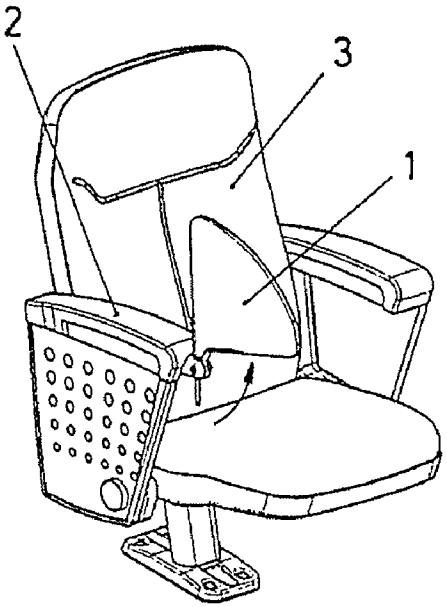

With all of the foregoing and starting from a folded position of the tablet (1) in the armchair (3), as shown in FIG. 1, to take the tablet (1) to the position for use, the tablet (1) has to be raised to a vertical position by rotating it with respect to the articulated assembly on the head (6) of shaft (5), as shown in FIG. 6, and then folding it to the horizontal position for use, as shown in FIG. 7.

Figure 8:
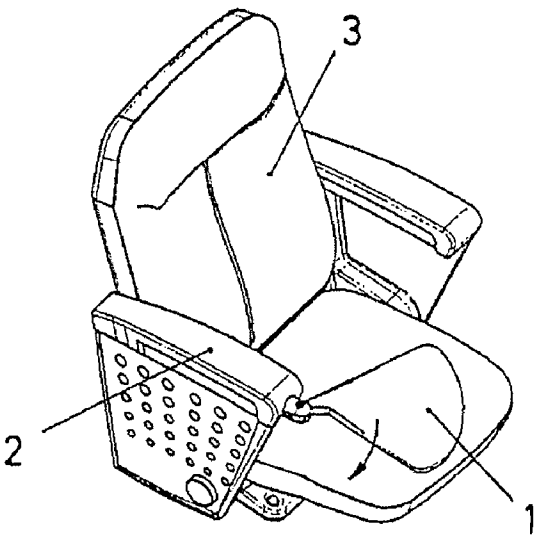
FIG. 8 shows the direction in which the tablet is pushed to make it fall form the position for use to the folded position.

However, to take the tablet (1) to the folding position form the position for use, it is only necessary to push the tablet (1) forwards, as indicated in FIG. 8, such that when a certain position is reached, the tablet (1) itself makes the shaft (5) rotate with respect to the support (4), so that the tablet (1) is in a position in which it falls into the folded position by its own weight.

When the furled position included under the corresponding armrest (2) is reached, the tablet (1) is retained in this position by means of a provisional blocking, due to the fitting of the end of the rod (10) into the notch (13) of the cam (7), preventing a rebound by which the tablet (1) may be improperly projected towards the front of the armchair (3) in a wrong folding and entailing an obstacle in the space in front of the armchair (3).

When the tablet (1) is taken forwards, the rotation of shaft (5) occurs by the weight of tablet (1) due to its shape, but with the purpose of increasing the efficiency and the rapidity of said rotation and with respect to the shaft (5), a torsion spring (14) is also incorporated in an arrangement tending to make said shaft (5) rotate in the direction which takes tablet (1) to the position which falls into the folded position.

The invention claimed is:

1. An armchair tablet hinge system for rotating and folding a tablet with respect to an armrest of an armchair comprising:

a support affixable to the armrest;

a rotatory hollow shaft rotatably housed in the support and having a head at one end of the shaft, the head projecting out from a front end of the support;

a cam affixable to the tablet, the cam rotatably mounted in the head of the shaft to provide articulation of the tablet;

a rod axially housed in the shaft and pushed by a spring to project one end of the rod through the head to provide a sliding rest against the cam;

a notch in the cam abutting the one end of the rod to provide provisional blocking of the rotation of the tablet;

an angular notch at a rear end of the support;

a bolt affixed perpendicular axially to the shaft and in the angular notch to limit rotation of the shaft with respect to stop position of ends of the angular notch; and a torsion spring acting on the shaft to rotate the shaft in a direction to make the tablet fall into a folded position under the armrest.

2. An armchair tablet hinge system for rotating and folding a tablet with respect to an armrest of an armchair comprising:

a support affixable to the armrest;

a rotatory hollow shaft rotatably housed in the support and having a head at one end of the shaft;

a cam affixable to the tablet, the cam rotatably mounted in the head of the shaft to provide articulation of the tablet;

a rod axially housed in the shaft and pushed by a spring to project one end of the rod through the head of the shaft; and a roller rotatable mounted on the one end of the rod, the roller abutting a notch in the cam to provide rotational support and a sliding rest to the cam, the notch providing provisional blocking of the rotation of the tablet.

3. An armchair tablet hinge system for rotating and folding a tablet with respect to an armrest of an armchair comprising:

a support affixable to the armrest;

a rotatory hollow shaft rotatably housed in the support and having a head at one end of the shaft, the head projecting out from a front end of the support;

a cam affixable to the tablet, the cam rotatably mounted in the head of the shaft to provide articulation of the tablet;

a rod axially housed in the shaft and pushed by a spring to project one end of the rod through the head to provide a sliding rest against the cam;

a notch in the cam abutting the one end of the rod to provide provisional blocking of the rotation of the tablet;

an angular notch at a rear end of the support;

a bolt affixed perpendicular axially to the shaft and in the angular notch to limit rotation of the shaft with respect to stop position of ends of the angular notch;

a torsion spring acting on the shaft to rotate the shaft in a direction to make the tablet fall into a folded position under the armrest; and a roller rotatable mounted on the one end of the rod, the roller abutting the notch in the cam to provide rotational support and the sliding rest to the cam.

* * * * *